US005393865A

United States Patent [19]

Ash et al.

[11] Patent Number: 5,393,865

[45] Date of Patent: Feb. 28, 1995

[54] POLY(ARYLENE SULFIDE) FIBRID PARTICLES AND PROCESS FOR THEIR PREPARATION

[75] Inventors: Carlton E. Ash, Sugarland, Tex.; Harold D. Yelton, Bartlesville, Okla.; Owen H. Decker, Reading, Pa.; Jon F. Geibel, Bartlesville, Okla.

[73] Assignee: Phillips Petroleum Company, Bartlesville, Okla.

[21] Appl. No.: 123,007

[22] Filed: Sep. 17, 1993

[51] Int. Cl.[6] ..... C08G 75/14

[52] U.S. Cl. ..... 528/388; 528/322; 528/323; 528/480; 528/491; 528/492; 528/493; 528/494; 528/495

[58] Field of Search ..... 528/322, 323, 388, 480, 528/491, 492, 493, 494, 495

[56] References Cited

U.S. PATENT DOCUMENTS

| | | | |
|---|---|---|---|
| 3,956,060 | 5/1976 | Scoggin | 159/47 |
| 4,950,529 | 8/1990 | Ikeda et al. | 428/224 |
| 4,960,861 | 10/1990 | Kotera et al. | 528/388 |

FOREIGN PATENT DOCUMENTS

| | | |
|---|---|---|
| 59-49232 | 3/1984 | Japan . |
| 02-160839 | 6/1990 | Japan . |

*Primary Examiner*—Samuel A. Acquah
*Assistant Examiner*—Shelley A. Dodson
*Attorney, Agent, or Firm*—Ryan N. Cross

[57] ABSTRACT

A method is provided for forming poly(arylene sulfide) fibrids by flashing a solution which is comprised of a poly(arylene sulfide) polymer in a polar organic compound and which is essentially free of solids under suitable conditions to form a solidified product comprising poly(arylene sulfide) fibrids.

25 Claims, 5 Drawing Sheets

POLY(ARYLENE SULFIDE) FIBRID PARTICLES AND PROCESS FOR THEIR PREPARATION

BACKGROUND OF THE INVENTION

This invention relates to crystalline poly(arylene sulfide) polymers in a fibrid form and the production of such poly(arylene sulfide) fibrids. More particularly, in a more preferred aspect, this invention pertains to the production of poly(arylene sulfide) fibrids useful in paper applications.

Poly(arylene sulfide) polymers are known in the art and have found wide use due to their desirable thermal and chemical resistance. Poly(arylene sulfide) polymers are useful in the formation of films, fibers, composites and molded parts by a variety of methods known to those of skill in the art.

Engineering polymers manufactured into papers have found many industrial applications, e.g., insulators for transformers and AC motors, separation media for battery cells, etc. The excellent heat and chemical resistance of poly(arylene sulfide) polymers coupled with their electrical insulation properties make them especially appealing for paper applications. However, in the past it has been difficult to obtain poly(arylene sulfide) polymers in a fibrid form. Fibrids are short irregular fibrous products suitable for use in felts, in paper making and for filtration products. A simplified and cost efficient method of producing poly(arylene sulfide) fibrids would be of great advantage in producing a high quality poly(arylene sulfide) paper. Therefore, it would be commercially advantageous to have an efficient process for preparing crystalline poly(arylene sulfide) in a fibrid form.

SUMMARY OF THE INVENTION

It is therefore, an object of the present invention to provide a poly(arylene sulfide) fibrid useful in paper applications.

It is a further object to provide a method of producing poly(arylene sulfide) fibrids.

The above objects are realized in a process wherein a solution which is comprised of a poly(arylene sulfide) polymer in a polar organic compound and which is essentially free of solids is flashed in a flash zone under suitable conditions to separate the solution into a vaporized polar organic compound which is removed from the flash zone and a solidified product comprising poly(arylene sulfide) polymer fibrids.

According to another aspect of the invention a poly(arylene sulfide) polymer is phase separated by contacting a poly(arylene sulfide) polymer with a polar organic compound and a phase separation promoter, selected from the group consisting of water, an alkali metal salt and mixtures thereof, wherein said phase separation promoter is soluble in said polar organic compound, at a temperature sufficient for the formation of a less dense polymer-lean liquid phase and a more dense polymer-rich liquid phase and at a pressure sufficient to keep the liquids present substantially in a liquid phase. Subsequently, said polymer-rich liquid phase is removed and is flashed under conditions suitable to recover said poly(arylene sulfide) from the polymer-rich liquid phase in the form of fibrids.

DETAILED DESCRIPTION OF THE PREFERRED EMBODIMENT

Figure 1:
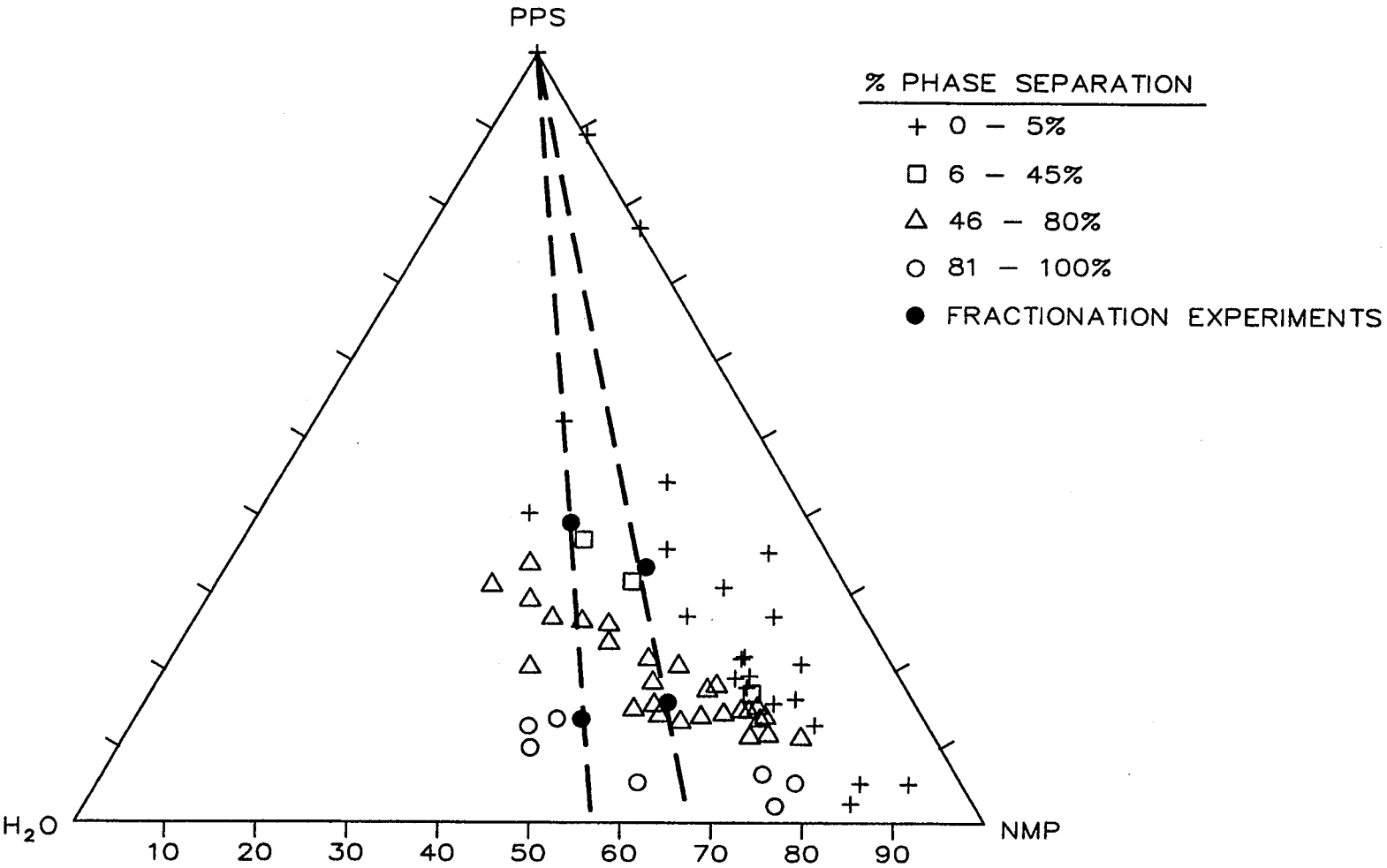
FIG. 1 graphically depicts the observed phase separation for a poly(phenylene sulfide) polymer (PPS) dissolved in N-methyl-2-pyrrolidone (NMP) using water ($H_2O$) as the sole phase separation promoter in a phase separation process.
Figure 2:
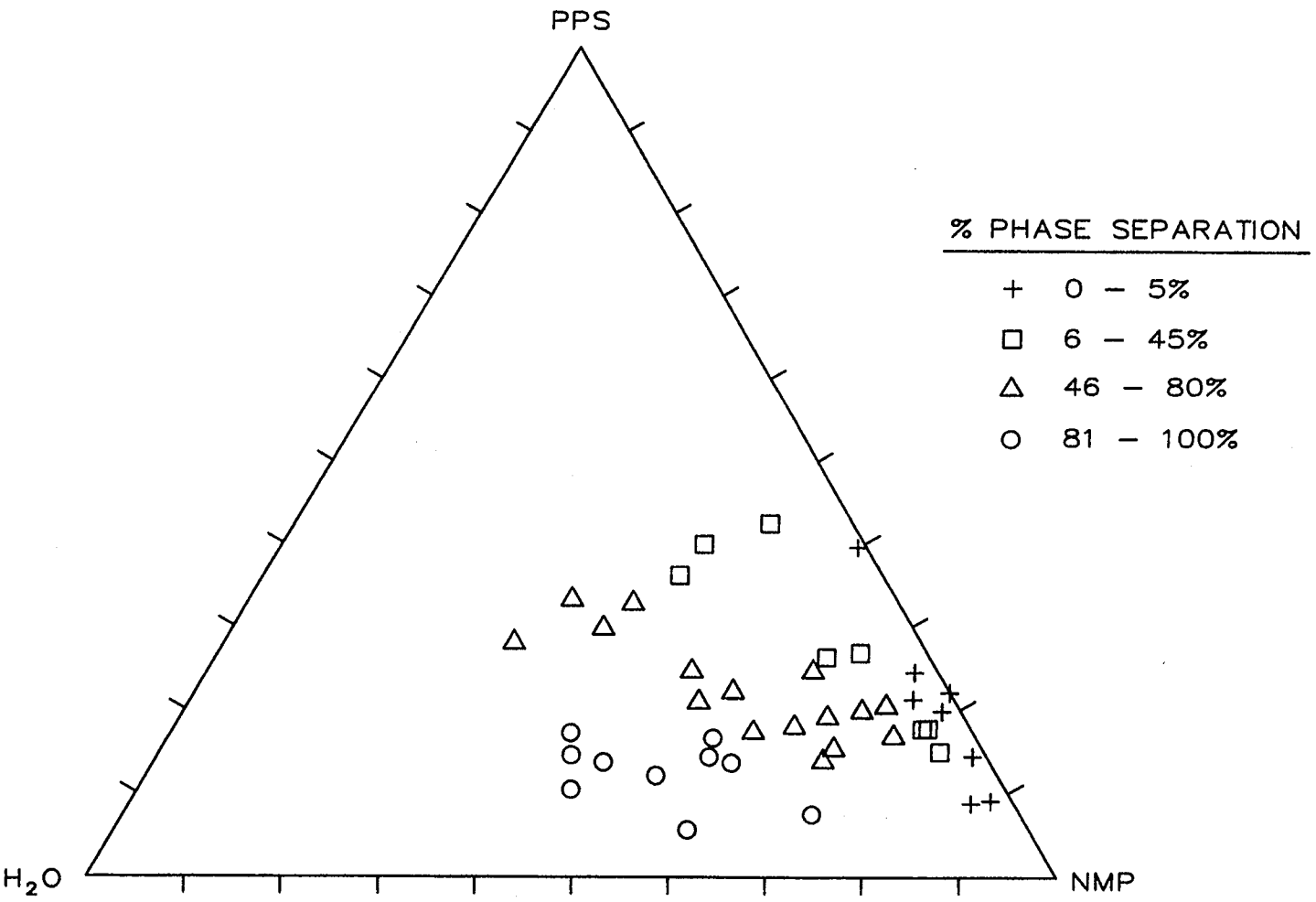
FIG. 2 graphically depicts the observed phase separation when a combination of water and sodium acetate is used as the phase separation promoter in a phase separation process.
Figure 3:
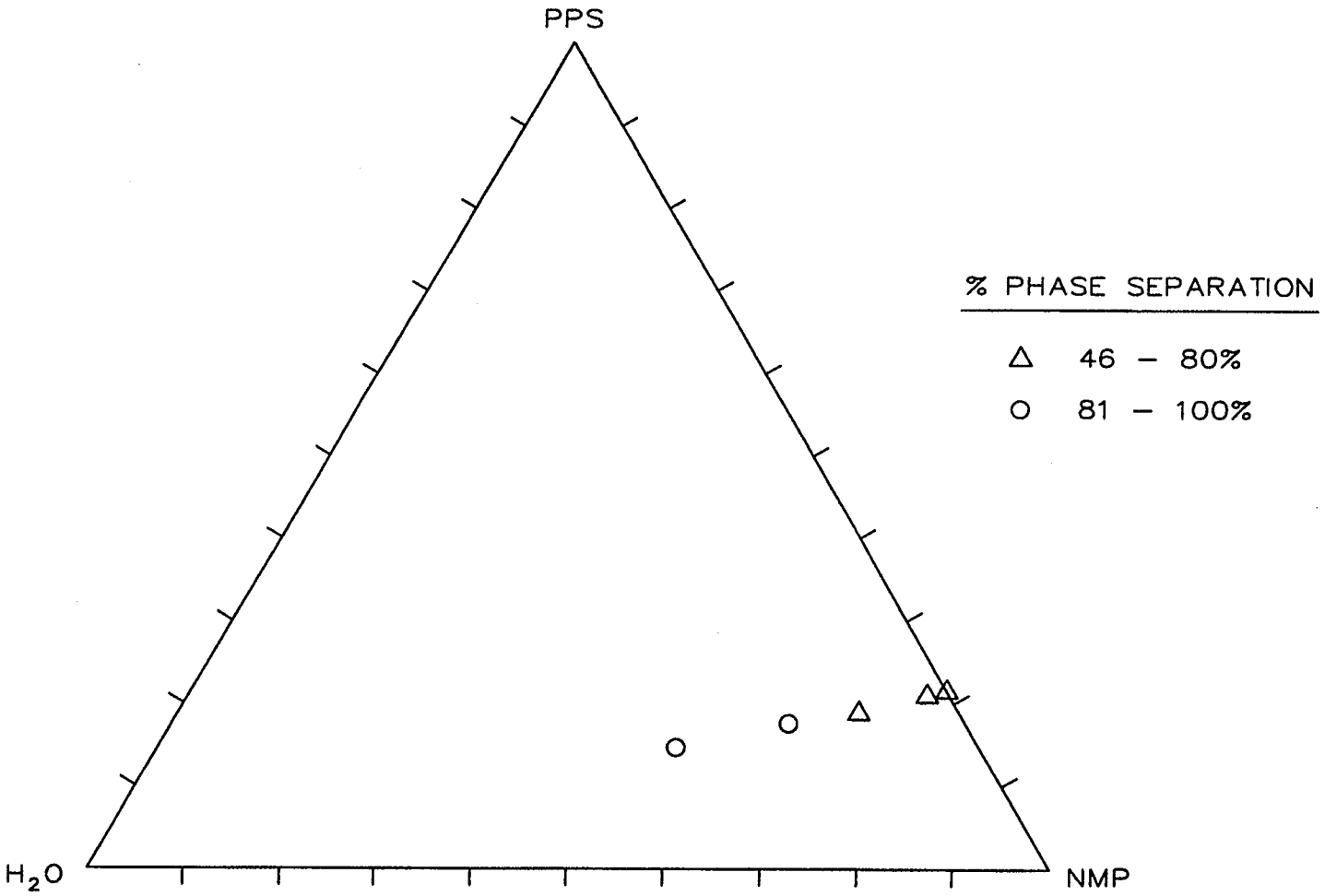
FIG. 3 graphically depicts the observed phase separation when a combination of water and sodium benzoate is used as the phase separation promoter in a phase separation process.
Figure 4:
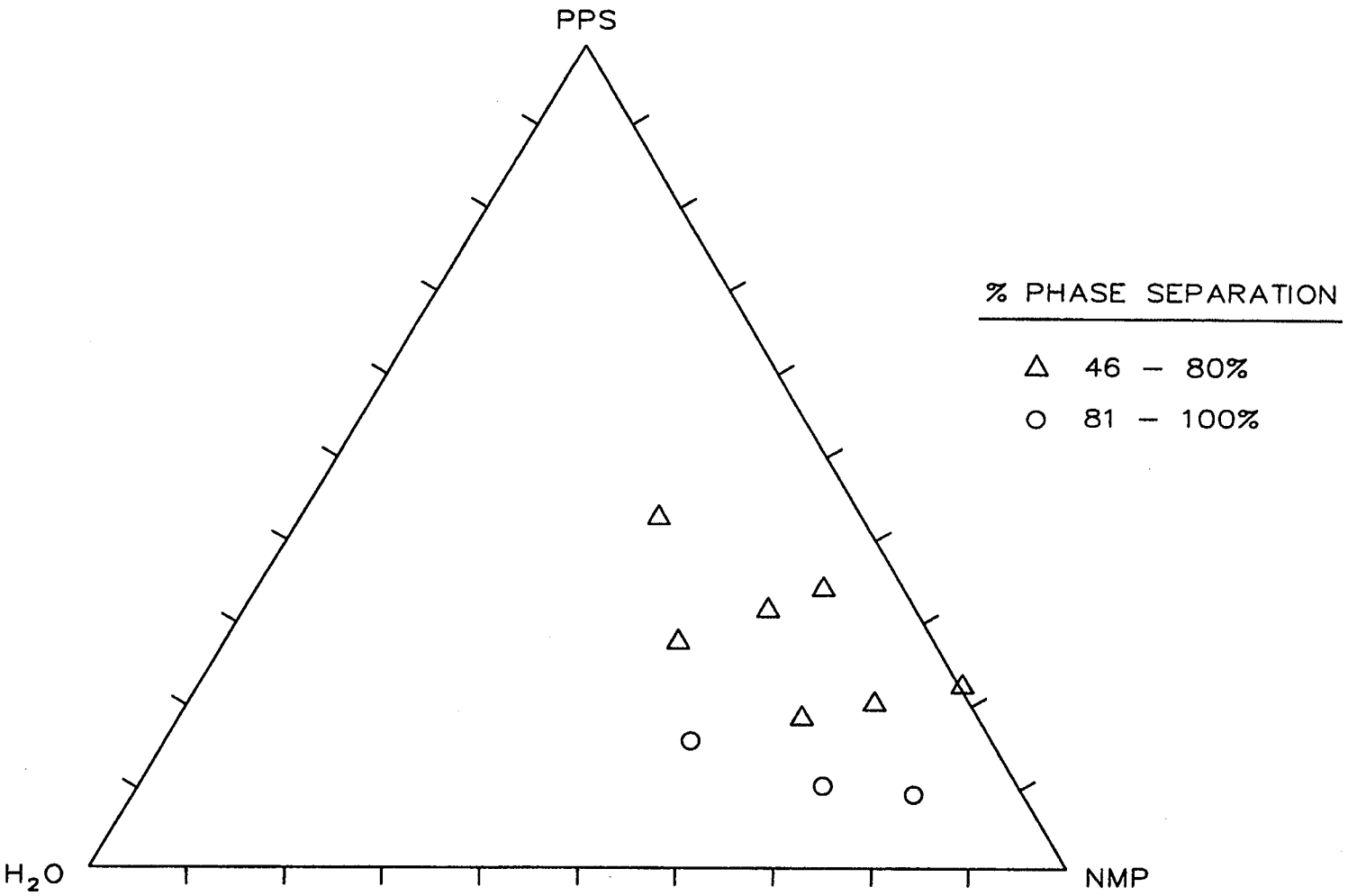
FIG. 4 graphically depicts the observed phase separation when a combination of water and lithium benzoate is used as tile phase separation promoter in a phase separation process.
Figure 5:
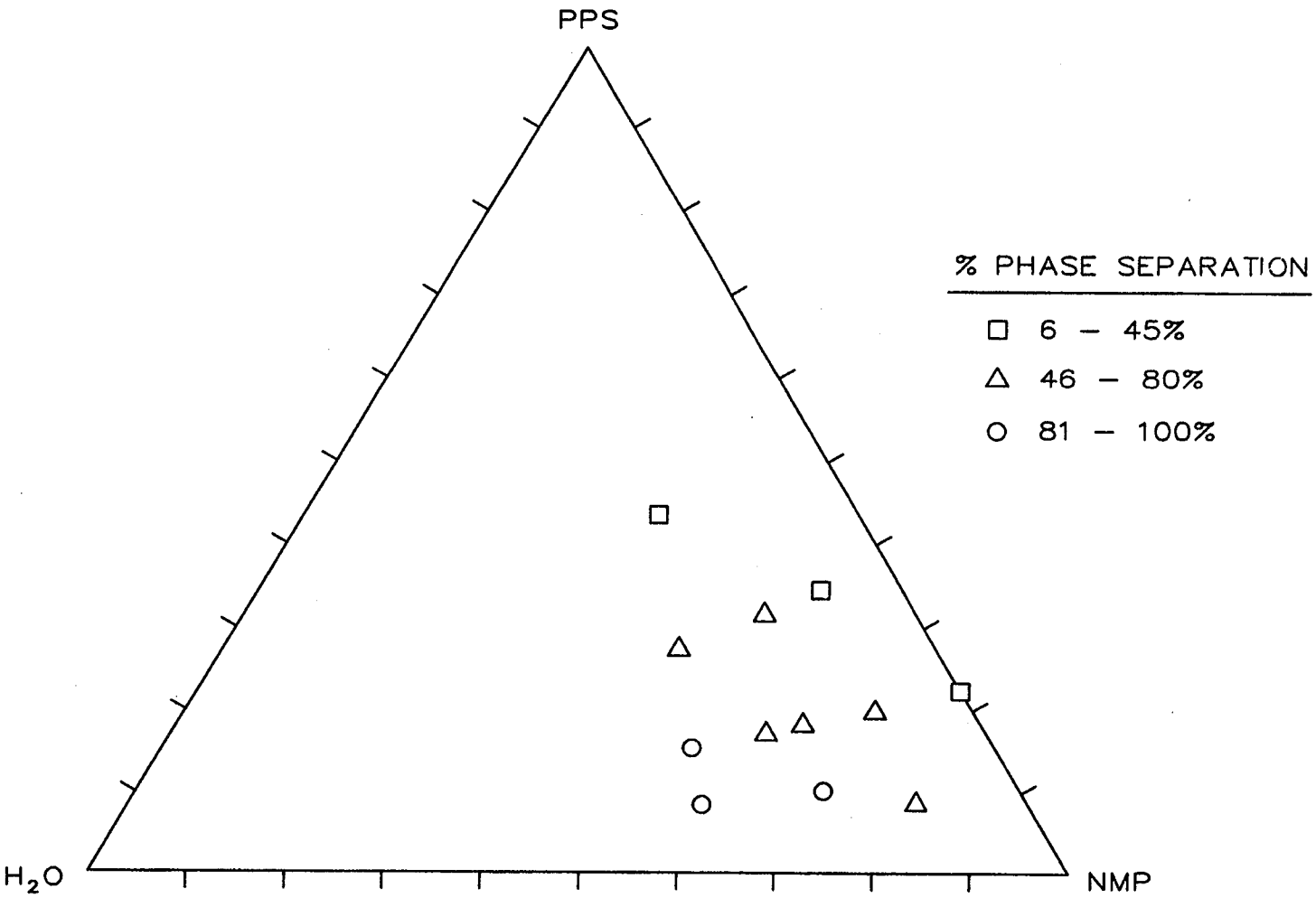
FIG. 5 graphically depicts the observed phase separation when a combination of water and lithium acetate is used as the phase separation promoter in a phase separation process.

In one embodiment of this invention, a poly(arylene sulfide) polymer, substantially free of solids, is dissolved in a polar organic compound under suitable conditions of heat and pressure to form a solution. The solution is then additionally pressurized, if needed, and subsequently submitted to flash recovery. In the flash recovery, herein sometimes referred to as flashing, the polar organic compound is vaporized and this vapor separates from the poly(arylene sulfide) polymer leaving the poly(arylene sulfide) polymer in the form of fibrids. The vaporization is accomplished by exposing the polymer solution to a sudden drop in pressure and, optionally, temperature. The decrease in pressure and temperature should be sufficient so that a sufficient portion of the polar organic compound, and any other liquid present in the solution, is vaporized to cause the polymer to solidify.

Fibrids, as used herein, will refer to very fine, highly branched discontinuous fibers. Generally, fibrids will have a length on the order of about 0.1 mm to about 3 mm.

In a more preferred embodiment of this invention, a phase separated poly(arylene sulfide) polymer, dissolved in a polar organic compound and water, in the absence of any essential amount of solids, is obtained by extraction from a phase separation process. The solution is then additionally pressurized, if needed, and subsequently submitted to flash recovery under suitable conditions to form fibrids.

Preferably, the phase separated poly(arylene sulfide) polymer used in forming fibrids herein will be that poly(arylene sulfide) polymer phase which contains essential].y all of the higher molecular weight polymer and a minor portion of the lower molecular weight polymer. Typically, this will have a melt flow of about 1000 g/10 min or less, preferably about 500 g/10 min or less, and most preferably 250 g/10 min or less.

In the practice of this invention, the poly(arylene sulfide) polymer will be dissolved in a polar organic compound prior to flash recovery of the polymer. The polymer/polar organic solution can contain water as an additional component. Also, it is believed that some compounds that are soluble in the polar organic compound can be present in the solution without compromising the formation of polymer fibrids. This is useful where water and/or alkali metal salts soluble in the polar organic compound are used as promoters in obtaining a phase separated poly(arylene sulfide), as described below, and it is desired to flash the phase separated poly(arylene sulfide) directly to fibrid form without having to recover the polymer from the phase-separation solution and subsequently redissolve it.

Furthermore, it is important that the solution to be flashed be essentially free of any solids in order for the poly(arylene sulfide) fibrids to form. As used herein, "solids" refers to compounds insoluble in the polar organic compound and includes polymerization by-products, such as sodium chloride. The presence of solids will inhibit the formation of fibrids during flashing if such compounds are present in the solution. Accordingly, polymerization process by-products which are insoluble in the polar organic compound, such as certain alkali metal by-products, for example sodium chloride, will interfere with the formation of fibrids. For example, sodium chloride is a common poly(arylene sulfide) polymerization by-product and typically is present in the polymer product in a very fine particulate form. While sodium chloride is virtually insoluble in the polar organic compounds used to form the polymer solution of this invention, this fine particulate form of sodium chloride can become dispersed in the solution. While not wishing to be bound by theory, it is believed that this dispersed sodium chloride functions as a suspending agent and causes the flashed polymer to be small granules as opposed to stringy fibrids; thus, sodium chloride, as well as other solids, should be removed prior to flashing to form fibrids.

Exemplary methods of removing the solids are high temperature filtration, centrifugation, or washing the solid polymer with a liquid that will dissolve the solids but not the polymer. For example, sodium chloride by-product can be removed from the poly(arylene sulfide) polymer by recovering a solidified polymer from the polymerization vessel and washing it with water to remove the sodium chloride. The polymer can then be redissolved in a polar organic compound and subsequently flashed to form fibrids.

The temperature and pressure of the polymer solution prior to flashing are specific to the components used to form the solution. Generally, the pressure should be sufficient to keep the liquids in the solution in a quiescent liquid state; thus, the pressure should be high enough to prevent the liquids in the solution from vaporizing prior to flashing. If the solution is held in a pressurized vessel prior to transfer of the solution to a flash vessel for flashing, the pressure should be high enough to prevent substantial vaporization of the liquids when a portion of the solution is transferred to the flash chamber. Additionally, the pressure should preferably be high enough to prevent premature flashing in transfer tubes as described below. The pressure in the pressurized vessel can be increased by the introduction of nitrogen, carbon dioxide and/or any other suitable gas that will not react with the components of the polymer solution.

Generally, when N-methyl-2-pyrrolidone (NMP), is used as the polar organic compound, the poly(arylene sulfide) solution should be at a pressure above about 1.72 MPa (250 psig), preferably above about 2.07 MPa (300 psig), more preferably above about 2.76 MPa (400 psig), and most preferably at about 3.44 MPa (500 psig) to obtain good fibrid structures.

Generally, the solution should be at a temperature high enough so that the poly(arylene sulfide) is dissolved in the polar organic compound but at a temperature below which the polar organic compound and poly(arylene sulfide) decompose. Typically, for poly(-phenylene sulfide) in N-methyl-2-pyrrolidone the temperature will be in the range of from about 200° C. to about 300° C., preferably 220° C. to 290° C., and most preferably, 230° C. to 280° C. before the solution is submitted to flash recovery.

For good fibrid formation, premature flashing of the solution, i.e., flashing before entry into the flash recovery vessel, should be minimized. Generally, such minimization can be accomplished by employing higher pressures before flashing, i.e., for example, for NMP pressures above about 2.07 MPa (300 psig) and preferably above 2.76 MPa (400 psig) will aid in minimizing premature flashing. Additionally, reducing the diameter size of the tube which delivers the polymer solution to the flash recovery vessel will also reduce flashing before entry into the vessel. Generally, the polymer solution should be flashed to a pressure and temperature sufficient to vaporize enough polar organic compounds and other liquids present to cause the polymer to solidify. Typically, the pressure and temperature will be sufficient to vaporize a major portion of the polar organic compound and, preferably, vaporize substantially all the polar organic compound. Preferably, the polymer will be flashed to near ambient conditions.

Upon entering the flash chamber, the polar organic compound and the water, if present, in the solution being flash recovered will vaporize and the vaporized polar organic compound is removed from the flash recovery vessel. The poly(arylene sulfide) will form fibrids during the flash evaporation of the polar organic compound and promoters, if any, and these fibrids are removed as the solidified product of the flash recovery vessel. The inventive process will produce a product where substantially all the polymer is in fibrid form.

The poly(arylene sulfide) fibrids produced can be recovered from the flash recovery vessel and pressed into a paper form if desired. The conditions used to press the fibrids into paper can vary; however, generally, the heat and pressure should not be such that the fibrid structure is melted.

The poly(arylene sulfide) polymers useful in this invention can be made by any method known to those of ordinary skill in the art.

Examples of poly(arylene sulfide) polymers useful in this invention are those prepared according to U.S. Pat. Nos. 3,919,177, 3,354,129, 4,038,261, 4,038,262, 4,116,947, 4,282,347, 4,350,810, and U.S. Pat. No. 4,645,826, which patents are hereby incorporated by reference. The poly(arylene sulfide) polymers generally are prepared by contacting reactants comprising a dihalosubstituted aromatic compound, a sulfur source and a polar organic compound under polymerization conditions.

Specific examples of poly(arylene sulfide) polymers suitable for purposes of this invention include poly(2,4-toluene sulfide), poly(4,4'-biphenylene sulfide) and poly(phenylene sulfide). Because of its availability and desirable properties (such as high chemical resistance, non-flammability, and high strength and hardness) poly(phenylene sulfide) is the presently preferred poly(arylene sulfide). Amorphous polymers which do not crystallize will not form fibrids during flash recovery; therefore, poly(p-phenylene sulfide) is presently the most preferred poly(arylene sulfide). It is, however, within the scope of this invention to have minor portions of amorphous poly(arylene sulfide) present with the crystalline poly(arylene sulfide); thus, in a preferred embodiment, the major portion of the polymer would be poly(p-phenylene sulfide) but the polymer could also contain minor portions of poly(m-phenylene sulfide) and/or poly(o-phenylene sulfide).

It is preferable to produce the poly(arylene sulfide) by employing polymerization processes where a relatively high proportion of the polymer is initially polymerized to a relatively high molecular weight poly(arylene sulfide) because it is believed that higher molecular weight poly(arylene sulfide) will produce better fibrids than lower molecular weight poly(arylene sulfide) due to the higher mechanical strength of the higher molecular weight poly(arylene sulfide) fibrids. Polymers which are initially polymerized to relatively high molecular weight may be prepared using alkali metal carboxylates or other molecular weight modifying agents and/or polyhaloaromatic compounds during polymerization.

The poly(arylene sulfide) initially can be polymerized to relatively high molecular weight by the processes described in U.S. Pat. Nos. 3,919,177, 4,645,826, 4,116,947, or by any other process known to those of ordinary skill in the art which produces a high molecular weight poly(arylene sulfide) polymer. The preferred high molecular weight poly(arylene sulfide) for use in this invention is poly(phenylene sulfide). The melt flow of the high molecular weight poly(phenylene sulfide) is generally less than about 1,000 g/10 min.

While it is known in the art to cure in an oxidative heat treatment poly(arylene sulfide) to produce relatively higher molecular weights as reflected by increased melt viscosity, it is believed that such high molecular weight poly(arylene sulfide) would be less desirable for the production of fibrids due to the complex structures associated with curing of the poly(arylene sulfide) molecules.

After production of the poly(arylene sulfide) through polymerization, it is preferable to separate out at least a portion of the oligomers and other impurities. One process for removing low molecular weight and/or oligomeric poly(arylene sulfide) comprises contacting the poly(arylene sulfide) with a polar organic compound and a promoter which is at least one of an alkali metal salt which is soluble in the polar organic compound and water, at a temperature sufficient to form a less dense polymer-lean liquid phase and a more dense polymer-rich liquid phase. These liquid phases are separated from each other thereby effecting a recovery of the more dense polymer-rich liquid phase from the less dense polymer-lean liquid phase.

For convenience, the less dense polymer-lean liquid phase will hereinafter be referred to as the upper phase and the more dense polymer-rich liquid phase will be referred to as the lower phase. The lower phase contains essentially all of the higher molecular weight polymer and a portion of the lower molecular weight polymer, oligomers and other impurities. The upper phase contains the remainder of the lower molecular weight polymer, oligomers and impurities. The molar ratio of the polar organic compound to water, if employed, is similar in the upper and lower phases.

The formation of, and relative volume of the two phases depends on several factors. The molecular weight of the starting poly(arylene sulfide) polymer is one factor. Higher molecular weight poly(arylene sulfide) polymers more easily form two phases when placed in the polar organic compound/promoter mixture. Higher molecular weight poly(arylene sulfide) polymers cause the formation of more concentrated polymer-rich liquid phases; that is higher molecular weight polymer exists in a smaller volume of polar organic compound/promoter mixture, relative to the analogous volume of the polar organic compound/promoter mixture for a relatively lower molecular weight poly(arylene sulfide).

The type and amount of promoter used affects the formation of the two phases. If water is employed as the promoter, generally the addition of a greater amount of water aids in the formation of the two phases. If water and another promoter such as an alkali metal carboxylate are both present, less water is necessary to cause the formation of the two phases than when the second promoter is not present. Certain alkali metal carboxylates, notably lithium benzoate, aid in the formation of two phases without any water being present.

The formation of the two phases is also affected by temperature. While higher temperatures aid in the dissolution of solid polymer in the polar organic compound, lower temperatures appear to aid two phase formation. The temperature should remain below that at which the polar organic compound and/or promoters, polymers, oligomers and impurities decompose or vaporize, at the pressure employed. Generally, temperatures in the range of about 200°-300° C., preferably 220°-280° C., most preferably 230°-270° C., are employed.

In order to aid separation of the two phases, it is preferred that the system be quiescent. While some agitation appears to aid in the initial dissolution of the polymer into the liquid phase, agitation renders the separation of the two phases difficult. Thus, if agitation is employed, it is preferred to halt such agitation prior to attempting to separate the liquid phases.

The two liquid phases can be separated by any method known to those of ordinary skill in the art. For example, the lower phase can be separated from the upper in a mixer-settler apparatus including a means for detecting the boundary between the two phases based on viscosity, density or the like, with a port for removing the desired lower phase.

Upon separation, the higher molecular weight polymer-containing lower phase can be subjected to a process to recover the polymer; or additional polar organic compound and additional promoter can be added to the lower phase to cause the formation of two new phases. In this manner, the higher molecular weight polymer can be subjected to repeated fractionations to remove as much of the lower molecular weight fraction as is desired or practicable.

Preferably the lower phase, of the first or a subsequent fractionations, can be subjected to flash recovery to form fibrids, as described above. However, if desired, the poly(arylene sulfide) can be recovered from the polymer-rich liquid phase and later redissolved in a polar organic compound for the fibrid formation process.

The poly(arylene sulfide) polymer can be recovered from the lower liquid phase by any suitable method, for example, by vaporizing the polar organic compound/promoter mixture, or by lowering the temperature of the liquid phase to a point at which the polymer solidifies in the polar organic compound/promoter mixture and recovering the solid polymer by filtration or centrifugation.

The polar organic compounds useful in the practice of this invention are those in which the poly(arylene sulfide) polymer, oligomers and impurities are soluble. The polar organic compound should be miscible with water and/or be a solvent by itself or when mixed with water for the alkali metal salts used to promote phase separation. The polar organic compound should be chosen such that it is substantially liquid at the pressures and temperatures employed in this invention prior to flash recovery, but readily vaporizable during flash recovery.

Suitable polar organic compounds include organic amides, such as, for example lactams; high boiling alcohols; ethers; ketones; and sulfones. It is presently preferred to employ an organic amide as the polar organic compound. Suitable organic amides include, but are not limited to, N,N'-ethylene dipyrrolidone, N-methyl-2-pyrrolidone (NMP), N-methyl-caprolactam, N-ethyl-caprolactam, caprolactam, pyrrolidone, 1,3-dimethyl-2-imidazolidinone, tetramethyl urea, hexamethylphosphoramide, and N,N'-dimethylacetamide. It is presently most preferred to use NMP as the polar organic compound.

Any amount of polar organic compound can be employed which is sufficient to result in the formation of a solution. In other words, enough polar organic compound must be present to allow the poly(arylene sulfide) polymer, oligomers and impurities to dissolve. Generally, this amount will be in the range of 2:1 to 25:1 moles of polar organic compound per mole of sulfur in the polymer. If phase separation is performed prior to flash recovery, it should be noted that at polymer concentrations above about 0.5 moles of sulfur in the polymer per mole of polar organic compound, it is generally more difficult to form two easily separable phases.

Water can be present in the polymer solution to be flash recovered in any amount that will not interfere with fibrid formation. However, if the polymer is first phase separated, the amount of water used, if water is employed as a promoter, will generally be that amount necessary to aid in the formation of the two phases. As previously discussed, the amount of water used will vary according to other factors such as the molecular weight of the poly(arylene sulfide) to be treated according to this invention, the temperature of the poly(arylene sulfide) solution in the polar organic compound, the concentration of the polymer in the polar organic compound and the presence or absence of other promoter compounds. Broadly speaking, the amount will be about 0.2 to about 10 moles of water per mole of sulfur in the polymer.

The alkali metal salts that can be employed as promoters are alkali metal carboxylates and alkali metal halides.

Alkali metal carboxylates that can be employed in the formation of the two phases can be represented by the formula $R'CO_2M$ where R' is a hydrocarbyl radical selected from alkyl, cycloalkyl, aryl and combinations thereof such as alkaryl, aralkyl, and the like. The number of carbon atoms in said R' is within the range of about 1 to about 20 and M is an alkali metal selected from lithium, sodium, potassium, rubidium, and cesium.

Examples of some alkali metal carboxylates that can be employed in the process for phase separation include lithium acetate, sodium acetate, potassium acetate, lithium propionate, sodium propionate, lithium 2-methylpropionate, rubidium butyrate, lithium valerate, sodium valerate, cesium hexanoate, lithium heptanoate, lithium 2-methyl octanoate, potassium dodecanoate, rubidium 4-ethyl tetradecanoate, sodium octadecanoate, sodium heneicosanoate, lithium cyclohexane carboxylate, cesium cyclododecane carboxylate, sodium 3-methyl cyclopentane carboxylate, potassium cyclohexylacetate, potassium benzoate, lithium benzoate, sodium benzoate, potassium m-toluate, lithium phenyl acetate, sodium 4-phenyl cyclohexane carboxylate, potassium p-tolyl acetate, lithium 4-ethyl cyclohexyl acetate and the like and mixtures thereof.

While any amount of alkali metal carboxylate can be used that is sufficient to promote the formation of two phases, an amount within the range of about 0.01 to about 2 moles of alkali metal carboxylate per mole of sulfur in the polymer will generally be used when the alkali metal carboxylate is employed with water. When certain alkali metal carboxylates are employed as promoters without water, the amount employed will also generally be in the range of about 0.01 to about 2 moles of alkali metal carboxylate per mole of sulfur in the polymer.

The alkali metal halides useful in the formation of the two phases are those which are soluble in the polar organic compound or can be made soluble in a mixture of the polar organic compound and another promoter compound. For example, lithium chloride is useful as a promoter compound since it is soluble in certain polar organic compounds, such as, for example, NMP. In contrast, sodium chloride, when placed in NMP, is insoluble and thus not useful by itself as a promoter.

During the polymerization process, by-products can be produced which are insoluble in the polar organic compound used in this invention, such as, for example, the alkali metal halide by-product. In these circumstances, in order to form two separate and discrete liquid phases which can be more easily separated according to conventional methods, it is desirable that the majority of the insoluble alkali metal halide formed as a by-product of the poly(arylene sulfide) polymerization be removed. Additionally, as stated above, in order for fibrid formation during flashing, it is also desirable that a substantial amount of the insoluble alkali metal halides be removed.

Preferably, the polymerization reaction mixture is subjected to a process to remove the by-product alkali metal halide, such as for example, high temperature filtration or centrifugation, or washing the polymer particles with a compound in which the alkali metal halide is soluble but in which the polymer is not soluble. For example, sodium chloride by-product can be removed from a poly(p-phenylene sulfide) polymer produced as described in U.S. Pat. No. 3,919,177 by washing the polymer with water.

In a preferred embodiment, a solution of PPS in N-methyl-2-pyrrolidone (NMP), present in an amount of 2:1 to 25:1 moles NMP per mole of sulfur in the PPS, and water, present in an amount of 0.2 to about 10 moles of water per mole of sulfur in the PPS, is phase separated, as described above, to produce a more dense polymer-rich liquid phase. This more dense polymer-rich liquid phase is subjected to flash recovery to form fibrids. Prior to flash recovery this liquid phase is at a pressure above about 1.72 MPa (250 psig) and a temperature from about 200° C. to about 300° C., preferably above about 2.07 MPa (300 psig) and a temperature from about 200° C. to about 300° C., more preferably above about 2.76 MPa (400 psig) and a temperature from 220° C. to 290° C., and most preferably at about 3.44 MPa (500 psig) and a temperature of 230° C. to 280° C.

The following examples are intended to illustrate the invention but are not meant to limit the scope thereof.

EXAMPLES

In the following examples the poly(p-phenylene sulfide) (referred to in the examples as PPS) flow rates were determined by the method of ASTM D 1238-86, Procedure B-Automatically Timed Flow Rate Procedure, Condition 315/5.0 modified to use a five minute preheated time, with the values of melt flow expressed in units of grams per ten minutes (g/10 min).

Example I

In this example, the PPS sample used is designated as Polymer A and was produced with sodium acetate as a polymerization modifier. Polymer A had a melt flow of 188 g/10 min.

A glass reactor was used to conduct the solution behavior observations for this example. The contents of the glass reactor were stirred with a magnetic stirrer, during the heating period. The heating rate was about 1.4° C./min between 200° and 265° C. Once the desired temperature was reached, the stirrer was turned off and observations and/or phase height measurements were made without any agitation. Stirring was then reinitiated and the reactor was cooled. The contents of the reactor were then examined to determine whether two liquid phases existed and the extent to which the polymer was concentrated into its own phase.

In this example, various solutions of PPS in mixtures of NMP, water, and other phase separation promoters were formed in the reactor to examine the resulting PPS phase separation. Since the volume of the lower, polymer-rich liquid phase varies depending on the composition of the mixture, the phases were characterized by the amount of phase separation observed at 265° C. Using a melt density of 1.15 g/mL (determined by the method of ASTM D 1238-86) for PPS, the theoretical minimum lower phase volume for a true molten polymer phase was approximated. This theoretical lower phase volume was correlated to the extent to which the polymer in each mixture was observed to be concentrated into its own phase and the resulting value was the "percentage phase separation". If the lower phase volume observed equaled this theoretical value, this was defined to be 100 percent phase separation. If no liquid-liquid phase separation was observed, this was defined to be 0 percent phase separation, and, thus, there was only one liquid phase in the composition observed.

The results of this example were plotted on ternary phase diagrams in which the three variables plotted are mole fractions of PPS repeat units contained in the polymer, mole fraction of NMP and mole fraction of water. Further, other additives (for example, other phase separation promoters, such as sodium acetate and lithium benzoate) were added to the reactor mixtures. Each of these additives are illustrated in separate ternary phase diagrams. The diagrams are shown in FIGS. 1–5.

The observed ternary phase diagram for PPS Polymer A, NMP and distilled water at 265° C. in the absence of other additives is shown in FIG. 1. The dotted lines shown in FIG. 1 depict constant mole ratios of NMP and water for various PPS concentrations. FIGS. 2 through 5 show the effect of added sodium acetate, sodium benzoate, lithium benzoate, and lithium acetate, respectively, (all at the 0.3 mole of salt per mole of PPS repeat unit) on the ternary phase diagram for PPS Polymer A, NMP and distilled water at 265° C.

Example II

The PPS polymer used in this example was prepared by the following method. An aqueous sodium sulfide solution was prepared by mixing 888 kg (1958 lb) of a 50.51 weight percent NaOH solution with 1056 kg (2327 lb) of a solution containing 59.50 weight percent NaSH and 0.108 weight percent NaOH. This solution, plus 2100 kg (4629 lb) of NMP and 651 L (172 gallons) of a 36.24 weight percent aqueous solution of NaOAc, were added to a reactor. This mixture was first heated to 114° C. (238° F.) and then dehydrated to remove water by raising the temperature to a final temperature of 209° C. (408° F.) during 61 minutes.

Subsequently, the dehydrated mixture was transferred to a polymerization reactor and 1656 kg (3650 lb) of DCB and 1090 kg (2402 lb) of NMP were added to the polymerization reactor. The reactor mixture was heated for 95 minutes from initial conditions of 210° C. (411° F.) and 0.134 MPa (20 psig) to 246° C. (475° F.) and 0.813 MPa (118 psig). Reactor conditions were then increased to 266° C. (510° F.) and 1.22 MPa (177 psig). The reactor pressure was increased to 1.60 MPa (232 psig) with carbon dioxide and the polymerization was continued for another 30 minutes to final conditions of 266° C. (510° F.) and 1.39 MPa (202 psig).

The polymerization mixture was concentrated by partial flashing at about 266° C. (510° F.) while the pressure was reduced from 1.39 MPa (202 psig) to 0.41 MPa (60 psig) during 53 minutes. Finally, the concentrated slurry was further heated to about 282° C. (540° F.) and flashed in a blender in 91 minutes. The dry, salt-filled PPS was washed with ambient water and filtered on a belt filter. Then, the filter cake was washed with hot (190° C., 375° F.) water, cooled, and filtered on a belt filter. It was then dried at about 143° C. (290° F.) at atmospheric pressure with a residence time of about 30 minutes.

This batch of PPS had a melt flow of 152 g/10 min. It was blended with several other batches of PPS made in essentilaly the same manner to produce Polymer B with a final melt flow of 168 g/10 min.

A PPS flash recovery of the bottom polymer-rich liquid phase was carried out in an one-liter, 316 stainless steel autoclave fitted with an anchor stirrer and a bottom takeoff valve to remove the bottom fraction. A 6.35 mm ($\frac{1}{4}$-inch) tube, with an orifice of about 17 gauge diameter, bent to a 90° angle was connected to the valve. This tube directed the bottom fraction (flash flow) horizontally into a round 25.4 cm (10-inch) diameter tube constructed from a 1.9 mm (75-mil) sheet of polyethylene. The polyethylene tube was 88.9 cm (35 inches) long with cheese cloth on the down stream end and a section of about 1858 $cm^2$ (2-square feet) cut out of the top side and covered with an aluminum screen to allow vapors to escape. Accordingly, the flash flow entering the polyethylene tube was flashed to ambient conditions.

108.1 g of Polymer B was added to 54.0 g $H_2O$ and 446.08 g NMP in the autoclave. The contents of the autoclave were flushed with nitrogen, and the autoclave was closed up. The mixture was heated to 270° C. over a 1-hour and 50-minute time period, at which time the pressure was 2.03 MPa (295 psig). Next the autoclave was pressurized to 3.51 MPa (510 psig) using $N_2$. The mixture was stirred continuously during the heating and pressurizing to dissolve polymer in the $H_2O$ and NMP. After pressurization, the stirring was stopped and the solution was allowed to stand for 10 minutes to allow the two phases to settle. Next, the bottom phase was taken off and flashed to ambient conditions.

The resulting product was all fibrous product with good fibrid formation. The melt flow of the product was 163 g/10 min.

Example III

A similar procedure was used as was used in Example II except the polymer, designated Polymer C, was made by the following method. To a stirred autoclave were charged 1130 g-mole of sodium hydrosulfide (as an aqueous solution), 1141.8 g-mole of sodium hydroxide (as an aqueous solution), 370 g-mole of sodium acetate and 3330 g-mole of NMP. This mixture was dehydrated and subsequently charged with 1105.3 g-mole of p-dichlorobenzene. The temperature was then raised to 225° C. and held there for 5 hours. The temperature was then raised to 270° C. and held there for an additional 3 hours. At the conclusion of this polymerization cycle, the reaction mixture was cooled to approximately 93°–121° C. and then charged to another reaction vessel containing 500 L NMP. After extracting the crude reaction mixture with the additional NMP, the granular polymer was recovered by retaining it on a sieve. The product was then washed with water to remove residual NMP and other water soluble materials, including solids that could interfere with fibrid formation. The dried polymer had a melt flow of 27 g/10 min and was designated Polymer C.

108.1 g of Polymer C was added to 27.0 g $H_2O$ and 446.08 g NMP in the autoclave. The contents of the autoclave were flushed with nitrogen, and the autoclave was closed up. The mixture was heated to 270° C. over a 4-hour and 50-minute time period, at which time the pressure was 1.34 MPa (195 psig). Next, the autoclave was pressurized to 3.44 MPa (500 psig) using $N_2$.

The flash recovery resulted in a product with good fibrid formation. The melt flow of the product was 36.4 g/10 min.

Example IV

In this Example, the effect of flash recovering the polymer-rich bottom phase from a quiescent 2-phase solution of a higher molecular weight poly(p-phenylene sulfide) at a lower temperature and lower pressure than in Example II is demonstrated. The same laboratory flash recovery equipment described in Example II was used in this Example. The one-liter, 316 stainless steel autoclave was charged with 108.1 g of Polymer C, 36.0 g of distilled water and 446.08 g of NMP. The contents of the autoclave were flushed with nitrogen, and the autoclave was sealed up. The reaction mixture was heated up to 260° C. over a period of 1-hour and 45-minutes, at which time the pressure was 1.38 MPa (200 psig). The temperature of the reaction mixture was held at 260° C. for 15 minutes and then cooled to 250° C. over a period of 20 minutes. Cooling to 250° C. caused the autogenous pressure to drop to 1.21 MPa (175 psig). The agitation was then stopped and the autoclave was pressurized up to 1.38 MPa (200 psig) with nitrogen. The valve to the flash line was opened, however, only a dribble of product exitted the flash line, indicating that this polymer solution was not readily flash recoverable in this equipment under these conditions. The pressure in the autoclave was then increased to approximately 2.76 MPa (400 psig) with nitrogen and flash recovery was again attempted. Some product was obtained as fibrids under these conditions. The melt flow of these fibrids was 26.4 g/10 min. This Example illustrates that low pressures are not conducive to fibrid formation.

Example V

In this Example, the effect of flash recovering the polymer-rich bottom phase from a quiescent 2-phase solution of a high molecular weight PPS is demonstrated. The starting PPS (Polymer D) was an uncured film-grade PPS having a nominal melt flow of 70 g/10 min. The same laboratory flash recovery equipment described in Example II was used in this Example with the exception that the tubing attached to the bottom takeoff valve was equipped with a 6.35 mm ($\frac{1}{4}$ inch) Swagelock fitting and cap. The cap had three holes each approximately 1.59 mm (1/16 inch) in diameter to serve as nozzles from which the flash recovery should take place. The one-liter, 316 stainless steel autoclave was charged with 108.1 g of Polymer D, 50.76 g of distilled water and 446.08 g of NMP. The contents of the autoclave were flushed with nitrogen, and the autoclave was sealed up. The reaction mixture was heated up to 265° C. over a period of 1-hour and 30-minutes, at which time the pressure was 1.97 MPa (285 psig). The reaction mixture was held for 15 minutes during which time the temperature increased to 268° C. At the conclusion of this 15 minute hold period, the agitation was halted. The reaction mixture was then held in the quiescent state for 10 minutes, during which time the temperature decreased to 263° C. and the pressure decreased to 1.89 MPa (275 psig). No additional nitrogen pressure was added to the autoclave prior to flash recovery. The bottom takeoff valve was opened. The product which exited the 3-hole flash nozzle did not have fibrid form, but rather was an extruded, strand-like profile. These strands were cut into pieces and subsequently chopped into pieces in a Wiley Mill. The chopped product was washed with hot water to remove residual NMP. After drying, the product had a melt flow of 93.2 g/10 min. This Example showed poorer fibrid formation than Examples II and III. It is believed that the poorer fiber formation was a result of the lower pressure of the solution prior to flash recovery and premature flashing in the transfer tube.

The above examples illustrate the surprising result that by recovering poly(arylene sulfide) from a solids-free polar organic solution by flash recovery the poly(arylene sulfide) can be recovered in fibrid form as opposed to granular form.

That which is claimed is:

1. A process comprising:

flashing in a flash zone a solution which is comprised of a poly(arylene sulfide) in a polar organic compound selected from the group consisting essentially of organic amides, high boiling alcohols, ethers, ketones, sulfones and mixtures thereof and which is essentially free of solids under conditions suitable to separate the solution into a vaporized polar organic compound which is removed from said flash zone and a solidified product comprising poly(arylene sulfide) fibrids.

2. A process according to claim 1 wherein said solution is under sufficient pressure before said flashing to keep the liquids in said solution in a liquid phase until said solution undergoes flashing.

3. A process comprising:

forming a solution comprising a poly(arylene sulfide) in a polar organic compound selected from the group consisting essentially of organic amides, high boiling alcohols, ethers, ketones, sulfones and mixtures thereof under a first pressure sufficient to keep the liquids present in a liquid phase and wherein said solution is essentially free of any solids;

flashing said solution to a second pressure, lower than said first pressure, and to a temperature, lower than the melting point of said poly(arylene sulfide) so that a major portion of said polar organic compound is vaporized and a solidified product comprising poly(arylene sulfide) fibrids is formed.

4. A process according to claim 3 wherein said polar organic compound is N-methyl-2-pyrrolidone.

5. A process according to claim 4 wherein said first pressure is above about 1.72 MPa (250 psig).

6. A process according to claim 4 wherein said first pressure is above about 2.07 MPa (300 psig).

7. A process according to claim 4 wherein said first pressure is above about 2.76 MPa (400 psig).

8. A process according to claim 3 wherein said poly(arylene sulfide) is poly(phenylene sulfide).

9. A process according to claim 8 wherein said poly(phenylene sulfide) has a melt flow rate less than about 1000 grams/10 min. when measured according to ASTM D 1238-86 Condition 315/5.0.

10. A process comprising:

forming a solution of a poly(arylene sulfide) in a polar organic compound selected from the group consisting essentially of organic amides, high boiling alcohols, ethers, ketones, sulfones and mixtures thereof in a first zone under a first pressure sufficient to keep the liquids present in a liquid phase and wherein said first zone is essentially free of any solids; and transferring a portion of said solution to a second zone wherein said zone is at a temperature below the melting point of said poly(arylene sulfide) and is at a second pressure below said first pressure so that a major portion of said polar organic compound is vaporized and a solidified product comprising poly(arylene sulfide) fibrids is formed.

11. A process according to claim 10 wherein:

said solution further includes a phase separation promoter selected from the group consisting of water, an alkali metal salt, and mixtures thereof, wherein said phase separation promoter is soluble in said polar organic compound, and said first zone is at a temperature sufficient so that said solution forms a less dense polymer-lean liquid phase and a more dense polymer-rich liquid phase; and said portion of said solution transferred to said second zone is said more dense polymer-rich liquid phase.

12. A process according to claim 11 wherein said polar organic compound is N-methyl-2-pyrrolidone.

13. A process according to claim 12 wherein said first pressure is above about 1.72 MPa (250 psig) and said first zone is at a temperature in the range of about 200° C. to about 300° C.

14. A process according to claim 12 wherein said first pressure is above about 2.07 MPa (300 psig) and said first zone is at a temperature in the range from 220° C. to 290° C.

15. A process according to claim 12 wherein said first pressure is above about 2.76 MPa (400 psig) and said first zone is at a temperature in the range of 230° C. to 280° C.

16. A process according to claim 12 wherein said poly(arylene sulfide) is poly(phenylene sulfide).

17. A process according to claim 16 wherein said poly(phenylene sulfide) in said more dense polymer-rich liquid phase has a melt flow rate less than about 1000 grams/10 min. when measured according to ASTM D 1238-86 Condition 315/5.0.

18. A process comprising:

(a) forming a poly(arylene sulfide) in a polymerization reactor;

(b) removing from said polymerization reactor an effluent containing said poly(arylene sulfide), solids and a polar organic compound selected from the group consisting essentially of organic amides, high boiling alcohols, ethers, ketones, sulfones and mixtures thereof;

(c) recovering said poly(arylene sulfide) from said polymer effluent in a solidified form;

(d) removing from said poly(arylene sulfide) any residual solids to obtain a cleansed poly(arylene sulfide);

(e) dissolving said cleansed poly(arylene sulfide) in a polar organic compound to form a polymer solution; and (f) flashing at least a portion of said polymer solution under suitable conditions to obtain a solidified product comprising poly(arylene sulfide) fibrids.

19. A process according to claim 18 wherein, in step (d) said residual solids are removed by washing said poly(arylene sulfide) with a solvent which will dissolve said solids but which will not dissolve said poly(arylene sulfide).

20. A process according to claim 18 wherein, in step (d) said residual solids are removed by high temperature filtration.

21. A process according to claim 18 wherein, in step (d) said residual solids are removed by centrifugation.

22. A process according to claim 18 wherein, before step (f), a phase separation promoter is added to said polymer solution to form a promoter solution at a temperature sufficient so that said promoter solution forms a less dense polymer-lean liquid phase and a more dense polymer-rich liquid phase and said portion of said polymer solution flashed in step (f) is said more dense polymer-rich liquid phase.

23. A process according to claim 22 wherein, in step (d) said residual solids are removed by washing said poly(arylene sulfide) with a solvent which will dissolve said solids but which will not dissolve said poly(arylene sulfide).

24. A process according to claim 22 wherein, in step (d) said residual solids are removed by high temperature filtration.

25. A process according to claim 22 wherein, in step (d) said residual solids are removed by centrifugation.

* * * * *